US007513487B2

(12) United States Patent
Saito

(10) Patent No.: US 7,513,487 B2
(45) Date of Patent: Apr. 7, 2009

(54) CARBURETOR

(75) Inventor: Norio Saito, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 256 days.

(21) Appl. No.: 11/604,349

(22) Filed: Nov. 27, 2006

(65) Prior Publication Data

US 2007/0120274 A1 May 31, 2007

(30) Foreign Application Priority Data

Nov. 30, 2005 (JP) ..... 2005-344937

(51) Int. Cl.
*F02M 9/06* (2006.01)

(52) U.S. Cl. ..... 261/44.3; 251/124; 261/50.1; 261/DIG. 56

(58) Field of Classification Search ..... 261/44.3, 261/44.4, 50.1, 50.2, DIG. 12, DIG. 56; 251/121–124
See application file for complete search history.

(56) References Cited

U.S. PATENT DOCUMENTS

| | | | | | |
|---|---|---|---|---|---|
| 1,098,783 | A * | 6/1914 | Daimler | 261/43 |
| 3,931,368 | A * | 1/1976 | Barker et al. | 261/36.2 |
| 3,957,930 | A | 5/1976 | Birmingham | |
| 4,150,070 | A * | 4/1979 | Hashimoto et al. | 261/41.4 |
| 4,512,312 | A * | 4/1985 | Nakamura et al. | 123/702 |
| 5,538,673 | A * | 7/1996 | Edmonston | 261/44.3 |
| 5,988,602 | A * | 11/1999 | Yokoyama et al. | 261/35 |
| 6,505,821 | B1 * | 1/2003 | Edmonston | 261/44.3 |
| 2002/0113326 | A1 * | 8/2002 | Takano et al. | 261/39.2 |

FOREIGN PATENT DOCUMENTS

| | | | | |
|---|---|---|---|---|
| GB | 267319 A | | 3/1927 | |
| JP | 57-32042 A | * | 2/1982 | 261/DIG. 56 |
| JP | 63-109274 A | * | 5/1988 | 261/44.4 |
| JP | 10-26053 A | | 1/1998 | |

* cited by examiner

*Primary Examiner*—Richard L Chiesa
(74) *Attorney, Agent, or Firm*—Birch, Stewart, Kolasch & Birch, LLP

(57) ABSTRACT

To provide a carburetor in which, when a set screw is detached, a jet needle can also be detached along with the set screw. A carburetor of the variable venturi type has a venturi piston to adjust the venturi of an intake passage that is provided in a carburetor body. In the carburetor, the jet needle is attached as a unit with a cap member by screwing the cap member into the venturi piston. The carburetor includes a retaining mechanism, with help of which the cap member is engaged with the jet needle to form a single unit, when the cap member is detached from the venturi piston.

13 Claims, 5 Drawing Sheets

CARBURETOR

CROSS-REFERENCE TO RELATED APPLICATIONS

This nonprovisional application claims priority under 35 U.S.C. § 119(a) on Patent Application No. 2005-344937, filed in Japan on Nov. 30, 2005, the entirety of which is incorporated herein by reference.

BACKGROUND OF THE INVENTION

1. Field of the Invention

The present invention relates to a carburetor that adjusts a venturi of an intake passage by a traveling venturi piston.

2. Description of Background Art

According to the background art, a carburetor that adjusts a venturi of an intake passage by, for example, a venturi piston that is capable of moving up and down in a cylinder is used in a two-wheel motor vehicle. In a carburetor of this type, a recessed portion is formed in an upper part of the venturi piston. A set screw (cap member) is attached to the recessed part. A jet needle is attached to the venturi piston with the set screw. (For example, see Japanese Patent Laid-Open Official Gazette No. Hei 10 (1998)-26053)

When the jet needle in a configuration according to the background art is detached from the venturi piston, the set screw is first detached therefrom. The jet needle is then pinched out. When the set screw is detached; however, the jet needle is likely to be detached as well. For this reason, a structure is desired which combines the jet needle with the set screw, and which allows the needle to be detached along with the set screw.

SUMMARY OF THE INVENTION

The present invention has been made in the light of the above-described problem. An object of the present invention is to provide a carburetor in which the jet needle can be detached together with the set screw when the set screw is detached.

The present invention is applied to a carburetor of the variable venturi type. A carburetor of this type has a venturi piston to adjust the venturi of the intake passage formed in the carburetor. A cap member is screwed to the venturi piston, and thereby the jet needle is attached to the cap member to form a single unit. The present invention comprises a retaining mechanism that makes the cap member engaged with the jet needle to form a single unit even when the cap member is detached.

With the help of this structure, the cap member is engaged with the jet needle by the retaining mechanism, and the cap member is made so that it cannot be detached from the venturi piston in isolation even when the cap member is detached from the venturi piston.

In this case, the retaining mechanism has a brim portion formed at the tail end of the jet needle, a hole portion going right through the cap member, and a step portion formed in the hole portion. The step portion can be formed to prevent the brim portion from passing through the hole portion.

With the help of this structure, the step portion of the cap member is engaged with the brim portion of the jet needle, and the cap member is made not to be detached from the venturi piston in isolation, even when the cap member is detached from the venturi piston.

Alternatively, the retaining mechanism may be configured to have a ribbed portion formed in any one of the tail end portion of the jet needle or the cap member, and a hole portion formed in the other one of the above two. The hole portion has a entrance portion which is engaged with the ribbed portion, and which allows the ribbed portion to pass therethrough by elastic deformation.

With the help of this structure, the ribbed portion either of the jet needle or of the cap member is engaged with the hole portion, even in a case where the cap member is detached from the venturi piston. Therefore, the structure functions to retain the jet needle with the cap member. On the other hand, when the jet needle is attached to or detached from the cap member, the jet needle is allowed to pass through the hole portion by pressing the jet needle firmly into the hole portion to bend the ribbed portion by elastic deformation.

Since the carburetor of the present invention has retaining mechanism with which the cap member is engaged with the jet needle as a single unit, the jet needle can be taken out along with the cap member when the cap member is detached from the venturi piston. This configuration makes maintenance easier. In addition, when the jet needle is attached to the venturi piston, the jet needle is assembled to the cap member, and then the two can be attached to the venturi piston as a single unit. As a result, the assembling of the jet needle becomes easier.

In addition, the retaining mechanism has a brim portion formed at the tail end of the jet needle, a hole portion going through the cap member, and a step portion formed in the hole portion. The step portion is formed to prevent the brim portion from passing through the hole portion. For this reason, the step portion of the cap member, when the cap member is detached from the venturi piston, is engaged with the brim portion of the jet needle. The jet needle, thus formed into a single unit with the cap member, can be taken out along with the cap member. This configuration makes maintenance easier. In addition, when the jet needle is attached to the venturi piston, the jet needle is assembled to the cap member, and then the two can be attached to the venturi piston as a single unit. As a result, the assembling of the jet needle becomes easier.

Furthermore, the retaining mechanism has a ribbed portion formed in any one of the tail end portion of the jet needle or in the cap member. The retaining mechanism also has a hole portion formed in the other one of the two. The hole portion has an entrance portion which is engaged with the ribbed portion, and which allows the ribbed portion to pass therethrough. As a result, attaching the cap member to the jet needle is made to be the last thing to do when the cap member and the jet needle are assembled to the venturi piston.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
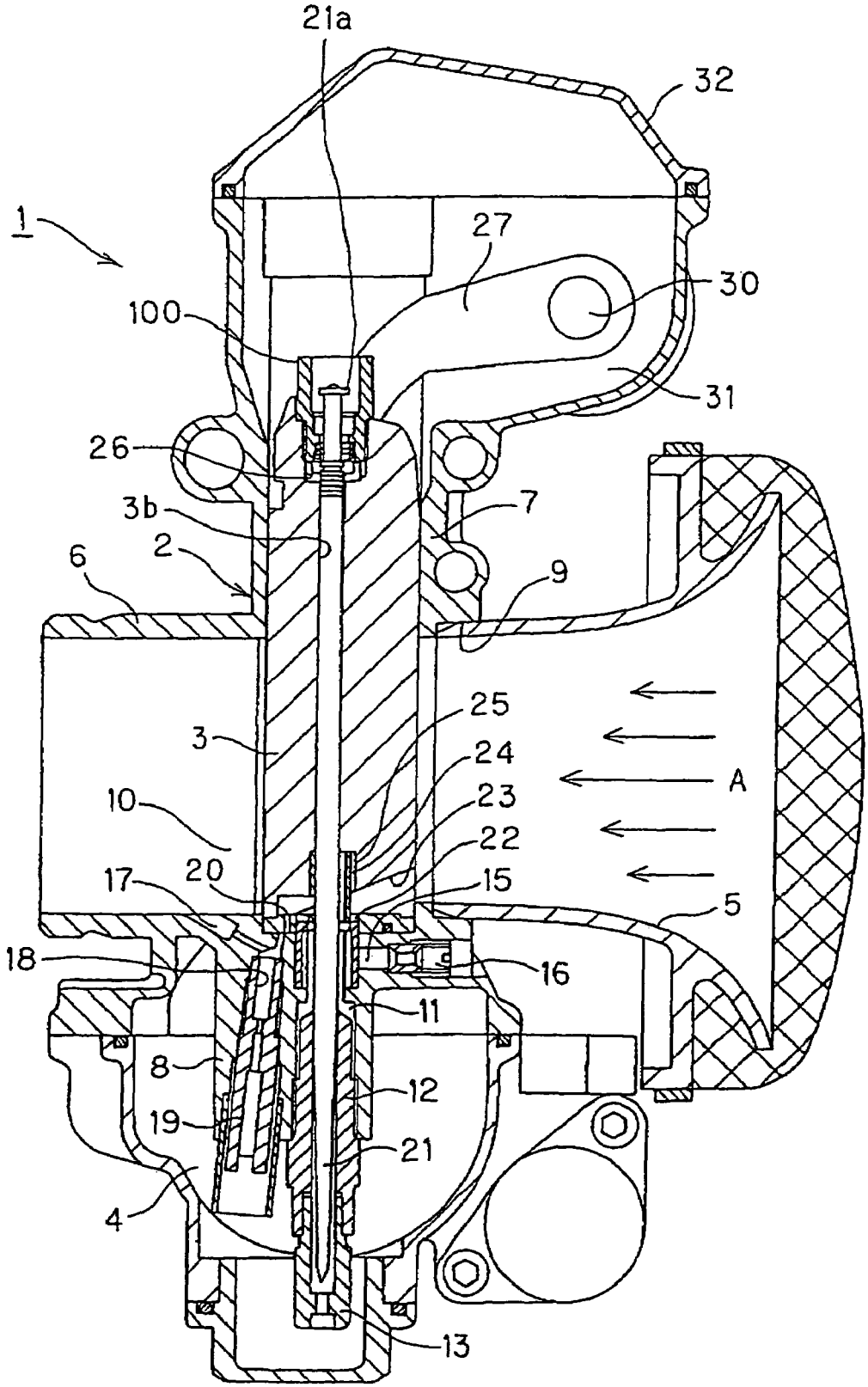
FIG. 1 is a vertical section of a carburetor according to an embodiment of the present invention.

An embodiment of the present invention will now be described with reference to the accompanying drawings. The same reference numerals will be used to identify the same or similar elements throughout the several views. It should be noted that each of the drawings should be viewed in the direction of orientation of the reference numerals.

FIG. 1 shows a vertical section of an entire carburetor of the variable venturi type, which is applied to an engine of a two-wheel motor cycle or the like. It should be noted that the directions, such as up, down, right, and left, referred to in the following explanation are the same as those in FIG. 1.

As shown in FIG. 1, a carburetor 1 has a carburetor body 2. An intake passage 6, a piston sliding chamber 7, and a fuel-passage-formed portion 8 are formed into a single unit, which is the carburetor body 2. A venturi piston 3, a float chamber 4, an air funnel 5, and a jet needle 21 are assembled to the carburetor body 2. The venturi piston 3 adjusts the amount of air intake. The float chamber 4 pools fuel. The air funnel 5 takes air into the intake passage. The jet needle 21 adjusts the amount of fuel to be mixed with air.

The air funnel 5 has a tubular shape expanding towards the upstream side of the intake air flow (right in FIG. 1). The small-diameter portion at the downstream side of the intake air flow (left in FIG. 1), or at the side of the flowing direction of air A, is fitted into a fitting portion 9, which is formed in the carburetor body 2, to be integrated into a single assembly.

The intake passage 6 is formed coaxially with the air funnel 5 and is made to be a passage of air. A venturi portion 10 is formed in the intake passage 6, and has a circular cross section. The venturi portion 10 opens and closes in response to the movement of the venturi piston 3, which slides up and down in FIG. 1. Thus, the air flow is adjusted.

The piston sliding chamber 7 extends vertically in FIG. 1, and is perpendicular to the axis of the air funnel 5 and of the intake passage 6. The venturi piston 3 is guided by the piston sliding chamber 7 slidably in the up and down directions. The piston sliding chamber 7 has an opening at the venturi portion 10 and forms the upper part of the carburetor body 2.

The fuel-passage-formed portion 8 extends downward in FIG. 1 from the part below the piston sliding chamber 7, and is formed to stick out into the float chamber 4. This fuel passage 8 has a main nozzle 11 formed therein as a main fuel passage to the venturi portion 10. The main nozzle 11 penetrates through the fuel-passage-formed portion 8 in the up and down directions of FIG. 1. The venturi portion 10 and the float chamber 4 communicate with each other through this main nozzle 11.

A nozzle tube 12 is screwed to the bottom of the fuel-passage-formed portion 8 to stick downward out of the main nozzle 11. A main jet 13 is screwed to the bottom of the nozzle tube 12. This main jet 13 has a hollow shape with an opening at the bottom thereof. The opening is submerged in the fuel pooled in the float chamber 4.

In addition, an air passage 15 is drilled in the upper part of the fuel-passage-formed portion 8. This air passage 15 has a first end in communication with the upper part of the main nozzle 11 in side to side directions and a second end opened at the side wall of the carburetor body. The side wall is the one at the upstream side of the intake air of the intake passage 6 and is located outside the air funnel 5. An air jet 16 is fitted into the air passage 15. Air is introduced into the venturi portion 10 from the second end through this air jet 16.

On the other hand, a slow nozzle 17 is formed in the fuel-passage-formed portion 8 as a fuel passage used at the time of low speed. This slow nozzle 17 has an opening at the inner wall of the intake passage 6. Therefore, the opening is located at downstream of the intake air from the venturi portion 10. This slow nozzle 17 is drilled from the bottom of the carburetor body 2 to the fuel-passage-formed portion 8. The slow nozzle 17 is in communication with the fuel below the surface thereof in the float chamber 4 through a bleed tube 18 and a slow jet 19. In addition, the part where the slow nozzle 17 and the bleed tube 18 connect with each other is in communication with the venturi portion 10 through a small-diameter passage 20.

The venturi piston 3 is shaped into a cylinder, and has a through-hole 3*b* made through it along the directions of the travel of the venturi piston 3. A jet needle 21 is inserted into the through-hole 3*b*. The details of the jet needle 21 will be explained below. The bottom of the venturi piston 3 is formed to be a cutaway 23, which is a slope face slanted up toward the upstream side of the intake air. In addition, the venturi piston 3 has a recessed portion 24 depressed upward at the bottom thereof. A screen 25 is provided in the recessed portion 24 to cover the jet needle 21 at the upstream side of the intake air. The screen 25 sticks up out of a needle jet 22, and enters the recessed portion 24 when the venturi piston 3 acts as a valve to close the opening.

The venturi piston 3 has another recessed portion 26 depressed downward in its upper portion at the center. A set screw (cap member) 100 is attached to the recessed portion 26. In addition, a link 27, specifically the lower end thereof, is pivotably connected to the upper portion of the venturi piston 3. The upper end of the link 27 is connected to a pivot member 30.

The pivot member 30 moves rotationally in conjunction with the operation of the accelerator (not shown). A rotational movement of the pivot member 30 caused by an operation of accelerator pulls up the venturi piston 3, or lets it go down, with help of the link 27. The up and down movement of the venturi piston 3 adjusts the degree of opening or closing of the venturi. At the same time, the degree of insertion of the jet needle 21 into the needle jet 22 is adjusted. The pivot member 30 is housed in a driving unit chamber 31, which is formed to continuously expand from the upper portion of the piston sliding chamber 7. The upper side of the driving unit chamber 31 is an opening. The upper-side opening is sealed by a cover 32 placed thereon.

The jet needle 21 has a long and thin shape, and has a brim portion 21*a* at the top thereof. This brim portion 21*a* sticks outward from the outer circumferential surface of the jet needle 21. In other words, the brim portion is a shoulder that extends outwardly from the outer circumferential surface of the jet needle 21.

The jet needle 21 is inserted into the through-hole 3*b* of the venturi piston 3. The lower end portion of the jet needle 21 reaches inside the main jet 13. The upper end of the jet needle 21 is attached to the venturi piston 3 with the set screw 100. The jet needle 21 advances and retreats in the up and down directions along with the venturi piston 3. The degree of insertion of the jet needle 21 into the needle jet 22, which is provided at the upper end portion of the main nozzle 11, determines the flow rate of the fuel passing through the main nozzle.

Figure 2:
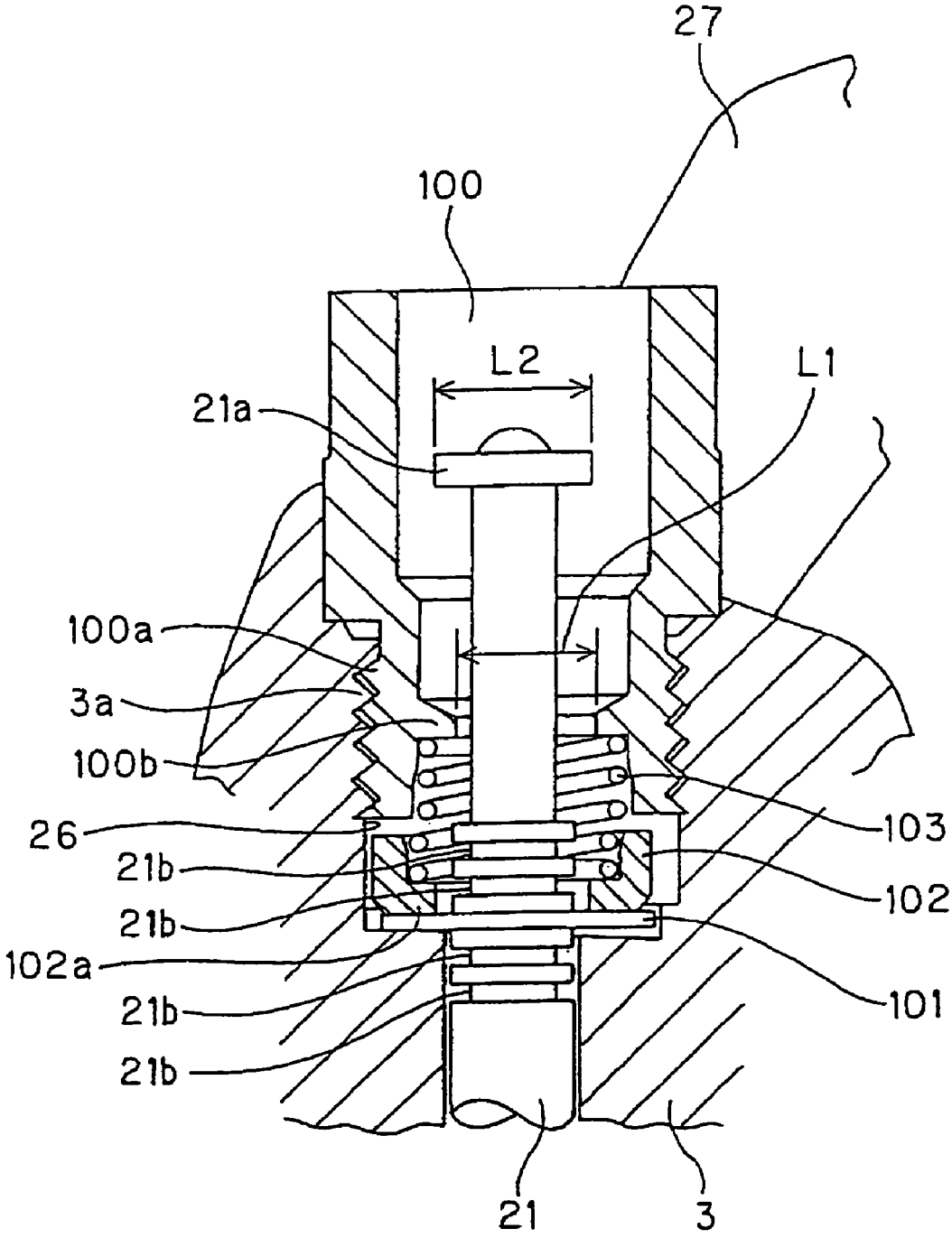
FIG. 2 is an enlarged section of the part of the carburetor where the set screw of the FIG. 1 is attached.

FIG. 2 shows an enlarged part of the carburetor where the set screw 100 is attached to the recessed portion 26 in the upper portion at the center of the venturi piston 3. The set screw 100 is attached together with a washer 101, collar 102, and a spring 103.

The set screw 100 is shaped into a hollowed cylinder with an opening at each of the two ends thereof. The lower part of the external circumferential surface is male threaded (hereinafter referred to as male thread 100*a*) as shown in FIG. 2. This male thread 100*a* is screwed with a tapped part of the recessed portion 26 (hereinafter, female thread 3*a*) in the upper portion of the venturi piston 3. The set screw 100 has two different-diameter parts divided in the middle thereof in the up and down directions. An internal diameter of the lower half is smaller than that of the upper half. The internal circumferential surface of the lower half has a step portion 100*b* sticking out inward to the axis of the set screw 100. The step portion 100*b* extends along the circumferential direction.

The internal diameter L1 of the step portion 100*b* is made smaller than the external diameter L2 of the brim portion 21*a* of the jet needle 21. As a result, when the jet needle 21 is inserted into the inside of the set screw 100, the brim portion 21*a* abuts on the step portion 100*b*.

The washer 101 has a flat plate shape. The washer 101 is fitted in one of a plurality of groove portions 21*b* with one of the flat faces of the washer 101 turning upward and the other, downward.

The collar 102 has a cylindrical shape, and has a hole at the center thereof. In addition, the collar 102 has a flange portion 102*a* formed on the internal circumferential surface at the lower side thereof. The flange portion 102*a* sticks out inward to the axis of the collar 102. The flange portion 102*a* extends along the circumferential direction. The upper portion of the jet needle 21 is inserted through the hole of the collar 102. The undersurface of the collar 102 is supported by the top surface of the washer 101.

The spring 103 has a coil shape. The upper portion of the jet needle 21 is inserted through the hole inside the spring 103. This spring 103 is placed between the set screw 100 and the collar 102. The lower end of the spring 103 abuts on the flange portion 102*b* of the collar 102, and the upper end of the spring 103 abuts on the step portion 100*b* of the set screw 100. The spring 103, in an assembled state, acts as a compression spring.

The procedure for assembling the sets crew 101 to the upper portion of the venturi piston 3 is as follows. First, the jet needle 21 is inserted into the set screw 100 from the upper side thereof. Subsequently, from the lower side of the jet needle 21, the spring 103 and the collar 102 are inserted onto the jet needle 21 in this order, and then, the washer 101 is attached to one of the groove portions 21*b*. In this way, with the help of the biasing force of the spring 103, the jet needle 21 and the set screw 100 are assembled into the form shown in FIG. 2. After that, the jet needle 21 is inserted into the venturi piston 3, and then, the set screw 100 is screwed into the venturi piston 3.

Figure 3:
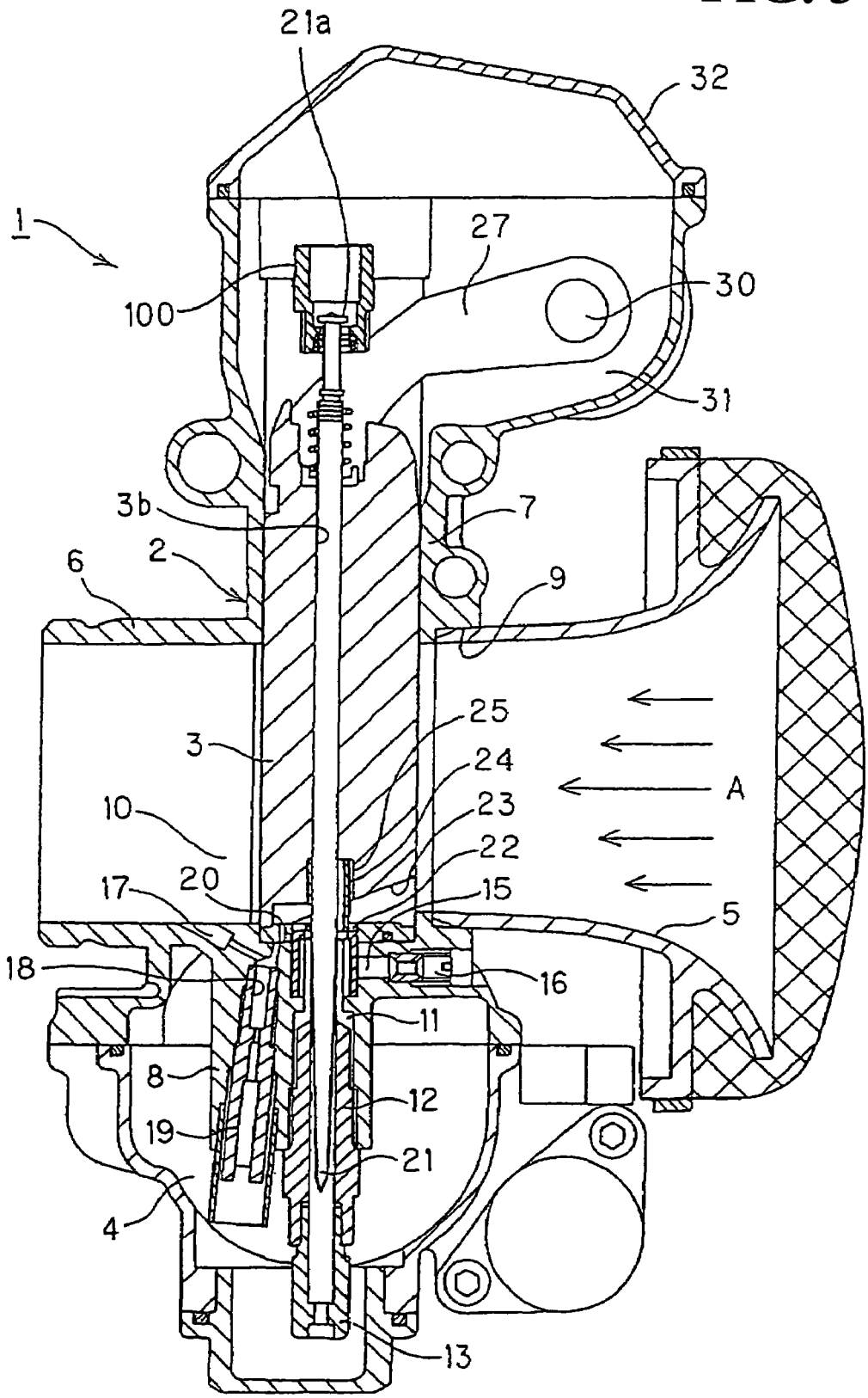
FIG. 3 is a vertical section of the carburetor 1 of the FIG. 1, but in a state where the set screw is screwed out.

FIG. 3 shows the carburetor 1 of the FIG. 1, but in a state where the set screw 100 is screwed out. When the set screw 100 is screwed out of the venturi piston 3 and moves upward from the venturi piston 3, the step portion 100*b* of the set screw 100 is engaged with the brim portion 21*b* of the jet needle 21. This prevents the set screw 100 from being screwed out of the venturi piston 3 and moving about inside the driving unit chamber 31, independently of the jet needle 21.

In addition, the jet needle 21 also moves freely upward. The jet needle 21, however, is long enough to restrict its movements only in the up and down directions along the through-hole 3*b* of the venturi piston 3. As a result, the set screw 100, along with the jet needle 21, moves only upward from the venturi piston 3 so that the set screw 100 will never enter the driving unit chamber 31 at the upper right of the venturi piston 3 in FIG. 1.

The carburetor in the embodiment of the present invention has the brim portion 21*a* and the step portion 100*b*, which together form the retaining mechanism. The retaining mechanism makes the set screw 100 and the jet needle 21 be engaged with each other when the set screw 100 is detached from the venturi piston 3. As a result, when the set screw 100 is detached, the engagement of the brim portion 21*a* of jet needle 21 with the step portion 100*b* of the set screw 100 helps the jet needle 21 to also be detached along with the set screw 100. This makes maintenance easier. In addition, when attached to the venturi piston 3, the set screw 100 and the jet needle 21 can be attached thereto as a set after the jet needle 21 is assembled to the set screw 100. This makes the assembly of the jet needle 21 easier.

Furthermore, even in a case where the set screw 100 is detached deliberately for the purpose of adjusting the carburetor, the retaining mechanism eliminates the possibility of dropping the set screw 100 in the driving unit chamber 31 by accident. Accordingly, adjustment can be completed in a shorter period of time.

Hereinabove, the description has been given of an embodiment of the present invention. The present invention, however, is not limited to the embodiment described above. Any modification and amendment based on the technical concept of the present invention may be allowed.

Figure 4:
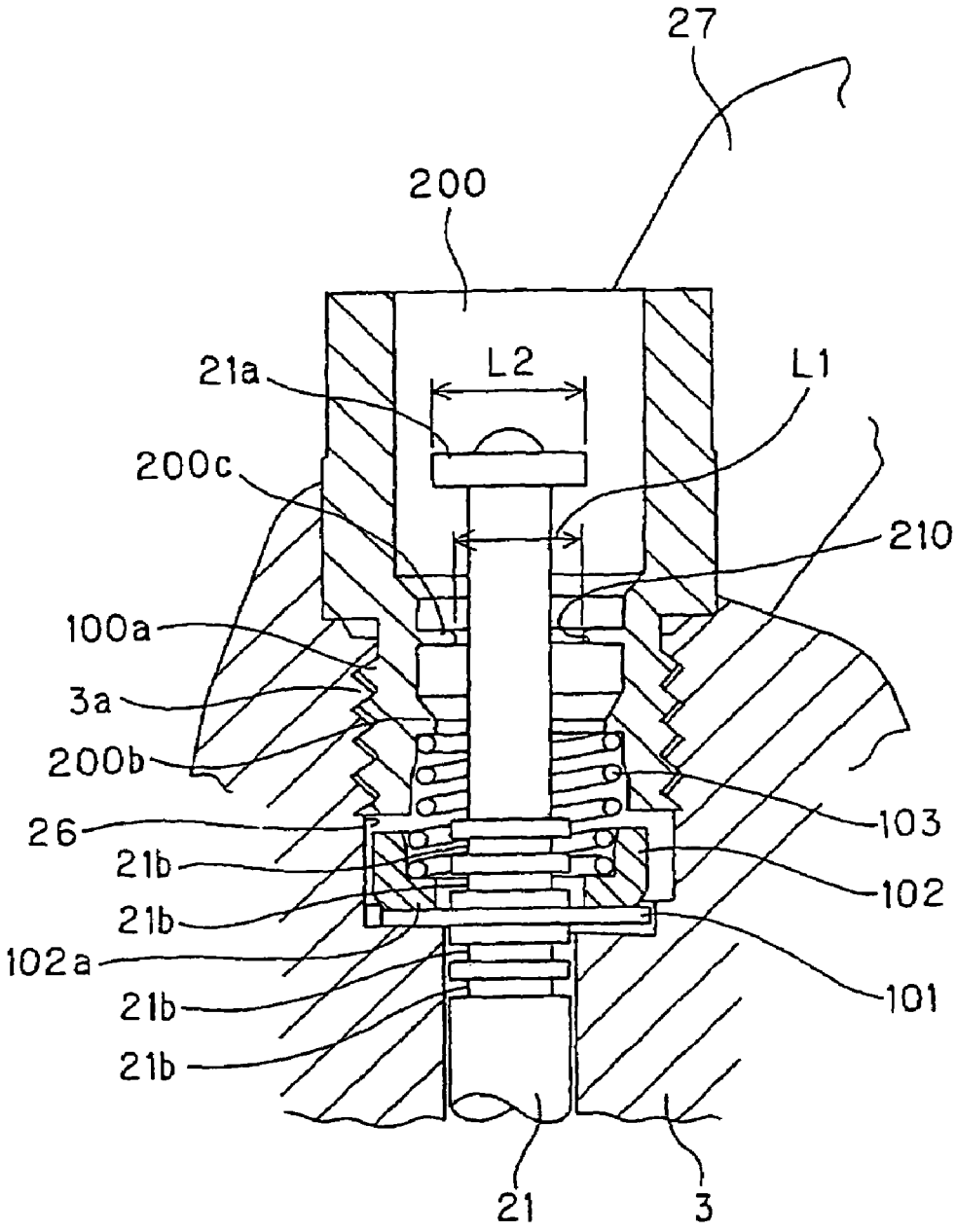
FIG. 4 is a sectional view showing a first modified example of the present invention in a state where the set screw is assembled.

For instance, as FIG. 4 shows, a step portion (spring retaining portion) 200*b* which retains the upper end of the spring 103 can be provided independently of a first ribbed portion 200*c* with which the brim portion (a second ribbed portion) 21*a* of the jet needle 21 is engaged. This first ribbed portion 200*c*, sticking out of the internal circumferential surface of the set screw 200 inward to the axis thereof and extending along the circumferential direction, forms a hole portion (entrance) 210. The internal diameter L1 of the first ribbed portion 200*c* is made smaller than the external diameter L2 of the brim portion 21*a* In addition, the first ribbed portion 200*c* is formed of an elastically deformable material such as a resin.

With this configuration, the spring retaining portion 200*b* can be made to be a solid structure which is adequate to retain the spring 103. On the other hand, when the brim portion 21*a* is pressed firmly into the hole portion 210 to attach the jet needle 21 to the set screw 200, or to detach the jet needle 21 from the set screw 200, the first ribbed portion 200*c*, which is elastically deformable, bends to allow the brim portion 21*a* to pass through the hole portion 210. This makes it possible to adopt a different assembling procedure, as follows, of the jet needle 21 and the set screw 200. First, the spring 103, collar 102 and the washer 101 are attached to the jet needle 21. Subsequently, the jet needle 21 in this state is inserted into the through-hole 3*b*. Finally, the set screw 200 is screwed into the recessed portion 26*b* allowing the brim portion 21*a* of the jet needle 21 to pass through the entrance 210 from below. As a result, assembly of the jet needle 21 becomes easier, and adjustment of the carburetor can be completed in a shorter time.

Figure 5:
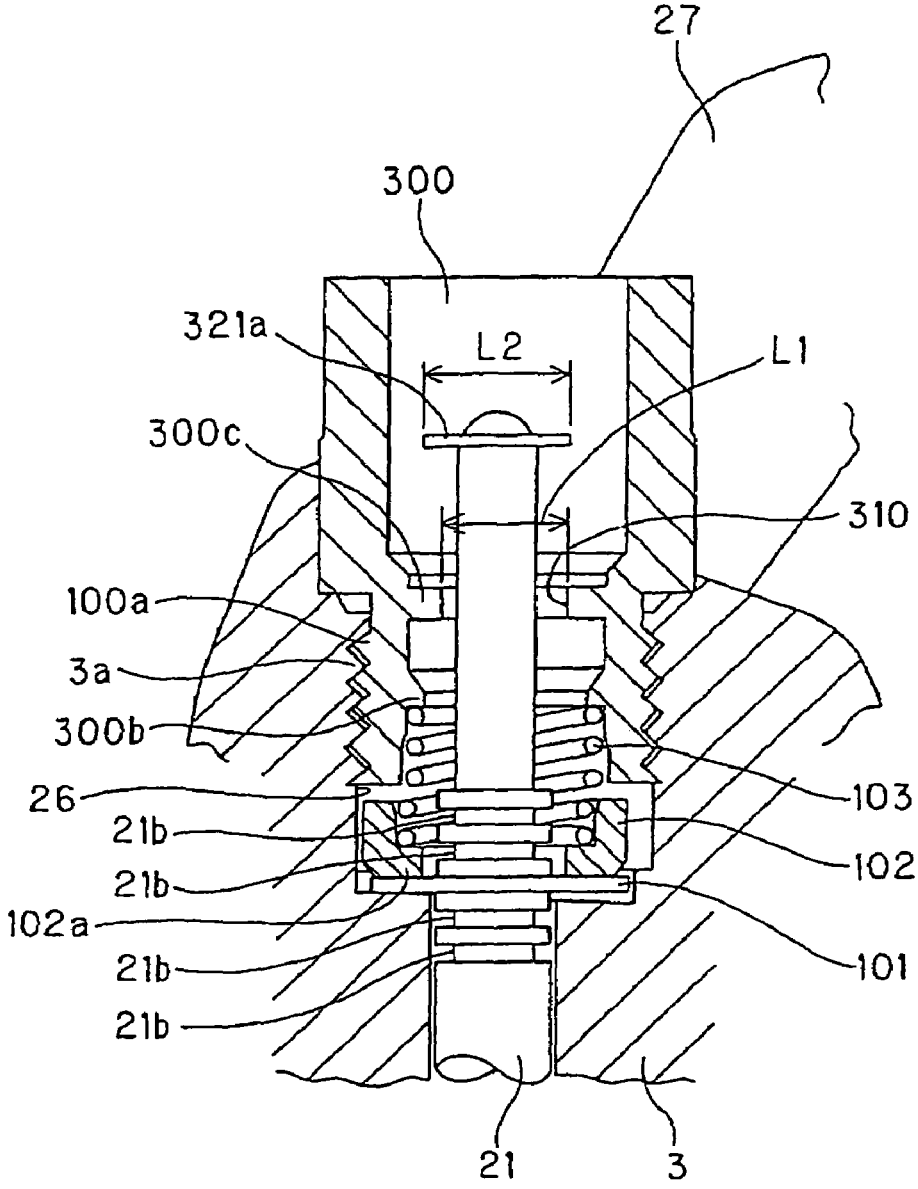
FIG. 5 is a sectional view showing a second modified example of the present invention in a state where the set screw is assembled.

Alternatively, the following configuration is also possible. As FIG. 5 shows, a step portion (spring retaining portion) 300*b* which retains the upper end of the spring 103 can be provided independently of a first ribbed portion 300*c* with which the brim portion (a second ribbed portion) 321*a* of the jet needle 321 is engaged. This first ribbed portion 300*c*, sticking out of the internal circumferential surface of the set screw 300 inward to the axis thereof and extending along the circumferential direction, forms a hole portion (entrance) 310. The internal diameter L1 of the first ribbed portion 300*c* is made smaller than the external diameter L2 of the brim portion 321*a* In addition, the brim portion 321*a* is formed of an elastically deformable material such as a resin.

With this configuration, the spring retaining portion 300*b* and the first ribbed portion 300*c* can be made to be a solid structure. On the other hand, when the brim portion 321*a* is pressed firmly into the hole portion 310 to attach the jet needle 21 to the set screw 200, or to detach the jet needle 21 from the set screw 200, the brim portion 321*a*, which is elastically deformable, bends to allow itself to pass through the hole portion 310. This, as in the case of the example shown in FIG. 4, makes it possible to adopt a different assembling procedure of the jet needle 321 and the set screw 300. As a result, assembly of the jet needle 321 becomes easier, and adjustment of the carburetor can be completed in a shorter time.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A carburetor, comprising:

a carburetor body including an intake passage;

a venturi piston provided in the carburetor body to adjust a venturi of the intake passage; and a cap member, said cap member being screwed into the venturi piston to allow a jet needle to be attached as a unit to the venturi piston, said cap member including a retaining mechanism that engages the jet needle to form a unit with the cap member, when the cap member is detached from the venturi piston, wherein the retaining mechanism includes: a brim portion provided at a tail end of the jet needle; a hole portion formed through the cap member; and a step portion formed in the hole portion, wherein the step portion is formed to prevent the brim portion from passing through the hole portion.

2. The carburetor according to claim 1, wherein a length of the brim portion is greater than a hole formed by the step portion, so that the brim portion cannot pass therethrough.

3. The carburetor according to claim 1, wherein the step portion extends radially inwardly into the hole portion, the step portion engaging the brim portion provided at a tail end of the needle jet.

4. The carburetor according to claim 3, wherein a width of the brim portion is greater than a hole formed by the step portion, so that the brim portion cannot pass therethrough.

5. The carburetor according to claim 1 wherein the step portion is formed of a rigid material to prevent passage of the brim portion and the retaining mechanism further includes a ribbed portion extending radially inwardly into the hole portion, one of the brim portion and ribbed portion formed of elastic material to permit passage of the brim portion past the ribbed portion.

6. The carburetor according to claim 5, wherein a length of the brim portion is greater than a hole formed by the ribbed portion, so that the brim portion cannot pass therethrough.

7. A carburetor comprising:

a carburetor body including an intake passage;

a venturi piston provided in the carburetor body to adjust a venturi of the intake passage; and a cap member, said cap member being screwed into the venturi piston to allow a jet needle to be attached as a unit to the venturi piston, said cap member including a retaining mechanism that engages the jet needle to form a unit with the cap member, when the cap member is detached from the venturi piston, wherein the retaining mechanism includes: a ribbed portion formed in a tail end portion of the jet needle, and a hole portion formed in the cap member, said hole portion having an entrance portion that is engaged with the ribbed portion, and that allows the ribbed portion to pass therethrough by elastic deformation.

8. A cap member and jet needle combination for a venturi piston in a carburetor, said cap member and jet needle combination comprising:

a threaded portion formed in the cap member for screwing into the venturi piston to allow the jet needle to be attached as a unit to the venturi piston, said cap member including a retaining mechanism that engages the jet needle to form a unit with the cap member, when the cap member is detached from the venturi piston, wherein the retaining mechanism includes: a brim portion provided at a tail end of the jet needle; a hole portion formed through the cap member; and a step portion formed in the hole portion, wherein the step portion is formed to prevent the brim portion from passing through the hole portion.

9. The cap member and jet needle combination according to claim 8, wherein a width of the brim portion is greater than a hole formed by the step portion, so that the brim portion cannot pass therethrough.

10. The cap member and jet needle combination according to Claim 8, wherein the step portion extends radially inwardly into the hole portion, the step portion engaging the brim portion.

11. The cap member and jet needle combination according to claim 10, wherein a width of the brim portion is greater than a hole formed by the step portion, so that the brim portion cannot pass therethrough.

12. The cap member and jet needle combination according to claim 8, wherein the step portion is formed of a rigid material to prevent passage of the brim portion and the retaining mechanism further includes a ribbed portion extending radially inwardly into the hole portion, one of the brim portion and ribbed portion formed of elastic material to permit passage of the brim portion past the ribbed portion.

13. The cap member and jet needle combination according to claim 12, wherein a width of the brim portion is greater than a hole formed by the step portion, so that the brim portion cannot pass therethrough.

* * * * *